United States Patent [19]

Nakase et al.

[11] Patent Number: 5,031,562

[45] Date of Patent: Jul. 16, 1991

[54] MARINE STEERING APPARATUS

[75] Inventors: Ryoichi Nakase; Masayoshi Nanami, both of Hamamatsu, Japan

[73] Assignee: Sanshin Kogyo Kabushiki Kaisha, Hamamatsu, Japan

[21] Appl. No.: 129,957

[22] Filed: Dec. 4, 1987

Related U.S. Application Data

[63] Continuation of Ser. No. 864,444, May 16, 1986, abandoned.

[30] Foreign Application Priority Data

May 17, 1985 [JP] Japan ..... 60-103951

[51] Int. Cl.[5] ..... B63H 25/22

[52] U.S. Cl. ..... 114/150; 244/196

[58] Field of Search ..... 114/144 R, 144 RE, 144 A, 114/150, 151; 440/61; 244/196; 91/516, 532

[56] References Cited

U.S. PATENT DOCUMENTS

| | | | |
|---|---|---|---|
| 2,985,410 | 5/1961 | Richter et al. | 244/196 |
| 2,998,945 | 9/1961 | Meyers | 244/196 |
| 3,468,126 | 9/1969 | Mercier | 114/150 |
| 3,488,954 | 1/1970 | Thomas et al. | 114/150 |
| 3,508,400 | 4/1970 | Mercier | 114/150 |
| 3,739,738 | 6/1973 | Cavil | 114/144 R |
| 4,373,920 | 2/1983 | Hall et al. | 440/59 |

OTHER PUBLICATIONS

Wagner Engineering Ltd.—Catalog (4 pages).

*Primary Examiner*—Jesus D. Sotelo
*Attorney, Agent, or Firm*—Ernest A. Beutler

[57] ABSTRACT

A combined manual and automatic steering for a watercraft wherein there is provided an automatic steering control and a manual steering control that is operative to override the automatic control upon manual operator actuation.

15 Claims, 1 Drawing Sheet

MARINE STEERING APPARATUS

This is a continuation of U.S. patent application Ser. No. 864,444, filed May 16,1986 now abandoned.

BACKGROUND OF THE INVENTION

This invention relates to a marine steering apparatus and more particularly to an improved apparatus for controlling the steering of a watercraft or the like.

In many marine applications, the watercraft is steered by an operator at a remote location. In order to effect this steering, the steering device of the watercraft, either the rudder or the outboard drive, is pivoted by means of a hydraulic or power cylinder that is associated with the steering device for moving it. This power cylinder is controlled at a remote location by an operator control wherein the operator sets the desired angular position of the steering device. This steering input is then transmitted through a suitable control circuit to operate a device for operating the power mechanism and steering the steering device until the desired position is reached. Although such systems offer convenient remote control, they can be slow in operation and do not permit the operator to override or manually control the steering device if he desires.

It is, therefore, a principal object of this invention to provide an improved marine steering apparatus wherein the operator may override the automatic operation.

It is a yet further object of this invention to provide an improved automatic and manual steering control for a watercraft.

It is a further object of this invention to provide an steering apparatus for a watercraft having a power cylinder for effecting steering movement and an automatic and manual control for the power cylinder.

SUMMARY OF THE INVENTION

This invention is adapted to be embodied in a steering system that comprises a steered member, a power device for operating the steered member and an automatic control device for operating the power device for placing the steered member in a position set by an operator. Manual steering means are provided for manually operating the power device for positioning the steered member in response to a manual input control.

DETAILED DESCRIPTION OF THE PREFERRED EMBODIMENTS

Figures 1, 2:
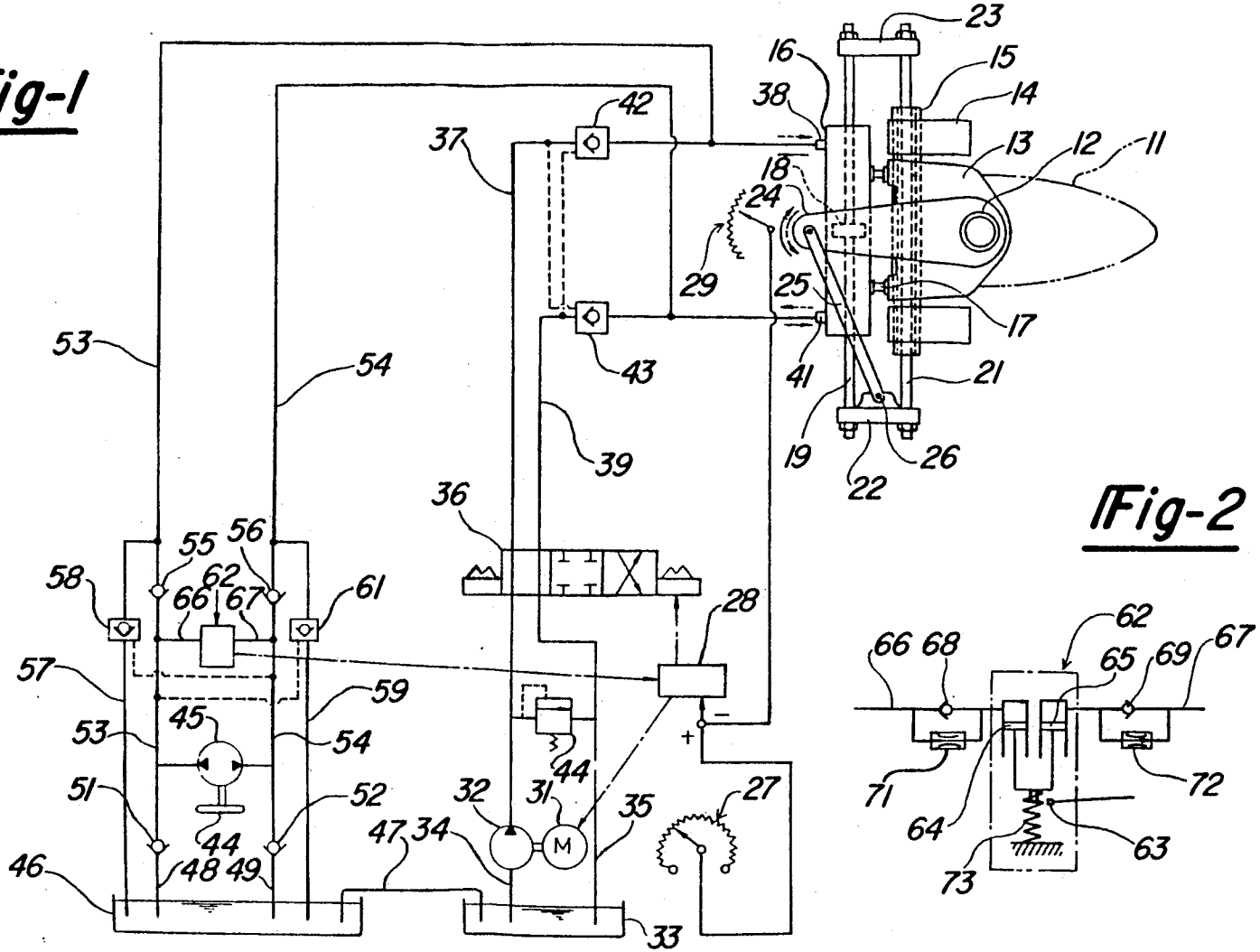
FIG. 1 is a partially schematic view of a marine steering apparatus constructed in accordance with an embodiment of the invention.
FIG. 2 is a partially schematic, cross-sectional view showing a component of the control device for disabling the automatic operator upon manual actuation.

Referring first to FIG. 1, a marine steering device is shown in phantom and is identified generally by the reference numeral 11. The steering device 11 may comprise a rudder, an outboard motor, or the outboard drive unit of an inboard/outboard drive. In the illustrated embodiment, the steering device 11 comprises an outboard drive that has a steering shaft 12 that is supported for pivotal movement about a vertically extending pivot axis by means of a swivel bracket 13 so as to steer the outboard drive 11. The swivel bracket 13 is, in turn, pivotally connected to clamping brackets 14 by means including a tube 15 for tilting movement of the outboard drive 11 about a horizontally extending tilt axis. The clamping brackets 14 are employed for affixing the outboard drive 11 to the transom (not shown) of an associated watercraft. This mechanism is believed to be well known to those skilled in the art.

A mechanism is provided for achieving power steering of the outboard drive 11 and this includes a hydraulically operated cylinder 16 that is connected to the swivel bracket 13 by means of posts or supporting elements 17. The hydraulic cylinder 16, therefore, will pivot with the swivel bracket 13 about the horizontally extending tilt axis. The hydraulic cylinder 16 has an internal bore that is divided into a pair of opposite chambers by means of a piston 18. The piston 18 is rigidly affixed to a through piston rod 19 that extends through the opposite ends of the cylinder 16 and which is appropriately sealed. The piston rod 19 is movable along an axis that is parallel to the tilt axis defined by the tube 15. A parallel rod 21 is slidably supported within the tube 15 and affixed to the piston rod 19 at the opposite ends of these rods by respective brackets 22 and 23.

A steering arm 24 is affixed to the steering shaft 12 and extends forwardly across the transom of the associated watercraft. A link 25 is pivotally connected at one end to the forward end of the steering lever 24 and at its opposite end to a lug 26 formed on the bracket 22 so as to transmit reciprocating movement of the piston 19 into rotary movement of the steering lever 24, steering shaft 12 and outboard drive 11 for effecting steering.

The angular position of the outboard drive 11 and operation of the hydraulic cylinder 16 may be controlled by a remotely positioned automatic operator, indicated generally by the reference numeral 27. The automatic operator 27 is positioned in proximity to the operator of the watercraft and may comprise, for example, a variable resistor or potentiometer. The automatic control member 27 provides its output signal to a controller 28, which also receives a signal from a steering angle sensor 29 that is associated with the outboard drive 11 for providing a signal to the controller 28 indicative of the angular or steered position of the outboard drive 11.

The controller 28 selectively sends a signal to a hydraulic circuit for actuating the cylinder 16 so as to position the outboard drive 11 in a location so that the steering angle sensor 29 sends a signal that corresponds to the automatic control input signal 27 to the controller 28 so as to achieve the desired angular or steered position. This hydraulic circuit includes an electric motor 31 which drives a pump 32 that draws fluid from a reservoir 33 through an input line 34. A return line 35 returns to the sump 33 and a three-way electrically controlled valve 36, controlled by the controller 28, controls the application of pressure to a first line 37 that extends to a first inlet port 38 at one end of the cylinder 16 and a second line 39 that extends to a second inlet port 41 at the opposite end of the cylinder 16.

A check valve 42 is placed in the line 37 for permitting flow from the line 37 to the port 38 and a similar check valve 43 is positioned in the line 49 for permitting flow from the line 39 to the port 41. The check valves 42 and 43 are pressure controlled so that when the line 37 is pressurized, the pressure in the line 37 will open the check valve 43 and when the line 39 is pressurized, this pressure will open the check valve 42. These controls are illustrated schematically by the dotted lines in the figure.

A pressure relief valve 44 is provided between the lines 37 and 39 downstream of the valve 36 for affording pressure relief.

The automatic steering mechanism operates as follows. When the operator provides an input signal to the automatic control 27, the controller 28 will process the steering angle sensor 29 signal with this input and if they differ, it will provide a control signal to the three-way valve 36 and the electric motor 31. If it is sensed that steering is required in a counterclockwise direction about the steering axis 12, the valve 36 will be positioned in the location shown in FIG. 1 and the electric motor 31 will be energized so that the pump 32 will pressurize its output port. This output port is then connected to the line 37 and the line 39 is opened back to the reservoir line 35. Fluid will flow under pressure into the port 38 so as to urge the piston 18 in a downward direction as shown in the figure. As has been previously noted, pressurization of the line 37 will effect opening of the check valve 43 and the port 41 then communicates with the line 39 for returning fluid to the reservoir 33. When the desired steered position is reached, the steering angle sensor 29 will send the signal to the controller 28 and the controller 28 will shift the valve 36 to its neutral or closed position and turn off the electric motor 31. The outboard drive 11 will then be held in the chosen steered position.

If the operator sets the automatic control 37 so as to require steering in the clockwise direction, the valve 36 is shifted by the controller 28 to the position where the line 39 becomes the pressure line and the line 37 becomes the return line. Under this condition, the check valve 43 will open so as to pressurize the port 41 and the check valve 42 will be open so that the port 38 functions as a return port. The piston 18 will then be urged upwardly as shown in FIG. 1.

The controller 28 may also provide a speed signal to the electric motor 31 dependent upon the sensed degree of variation between the automatic control 27 and the steering angle indicator 29. That is, under large deviations, the motor 31 may be driven at a high rate of speed and this rate of speed may be decreased by the controller 28 as the deviation from the desired steering angle diminishes.

Although this system provides automatic control and can be tailored to provide fairly rapid response, the system still operates with some time delay due to the fact that the controller 28 must sense the differences between the desired steered position and the actual steered position and provide reaction time. Therefore, in order to provide a manual override, there is provided a manually operated steering wheel 44 that can be employed for manual pressurization of the hydraulic cylinder 16 so as to effect manual steering of the outboard drive 11. The manual steering wheel 44 is connected to a positive displacement fluid pump 45 of the reversible type. The pump 45 communicates with a reservoir 46 which may, in turn, communicate with the reservoir 33 through a line 47. There are a pair of lines 48 and 49 in which respective check valves 51 and 52 are provided for communicating the pump 45 with the reservoir 46. The respective pump ports also communicate with a line 53 and a line 54. The lines 53 and 54 extend to intersect the lines 37 and 39, respectively, downstream of the check valves 42 and 43. Check valves 55 and 56 may be positioned in the lines 53 and 54 upstream of this point of communication.

A return line 57 communicates the line 53 with the sump 46 upstream of the check valve 55. A pressure controlled check valve 58 is provided in the line 57 for normally precluding flow through the line 57 back to the reservoir 46. The check valve is, however, opened when the line 54 is pressurized as shown by the schematic dotted line. In a similar manner, a return line 59 communicates the line 54 with the sump 46 upstream of the check valve 56. A pressure operated check valve 61 is positioned in the return line 59 for normally precluding flow through this return line but opening the line when the line 53 is pressurized, as shown by the dotted line view.

The device as thus far described operates as follows. If the operator is placed in an automatic control through the automatic control 27 and the outboard drive 11 is being steered in a counterclockwise direction as previously described and the operator decides to manually effect faster steering in this direction, he rotates the manual steering wheel 44 in a direction to operate the pump 45 so as to pressurize the line 53. Under this condition, fluid is drawn from the reservoir through the line 49 and check valve 52 and the check valve 51 will close. The check valve 55 wil then open so that the line 53 can pressurize the line 37 upstream of the check valve 42. If the operator is turning the steering wheel 44 rapidly enough, he will exert more fluid pressure than that exerted by the automatic pump 32 and the check valve 42 will close so that the operation of the hydraulic cylinder 16 is now under manual control. Again, the line 29 will operate as the return line. Fluid may be returned to the reservoir 46 through the line 54 and return line 59. The check valve 61 will be opened when the line 53 is pressurized, as aforenoted.

If the automatic control 27 has been effecting clockwise rotation of the outboard drive 11 and the operator desires to increase the speed of rotation in this direction, the steering wheel 44 is rotated so as to pressurize the line 54 and override the automatic pump 32, in a manner which is believed to be apparent from the foregoing description.

If the operator desires to either stop the automatic steering through manual steering or to override the automatic steering and effect steering in an opposite sense, this is also possible with the system as thus far described. For example, if the automatic operator 27 and controller 28 are effective to cause pivotal movement of the outboard drive 11 in the counterclockwise direction, the operator may rotate the steering wheel 44 in a direction to cause the pump 45 to pressurize the line 54. When this occurs, pressure will be supplied to the port 41 and if this pressure is sufficient to overcome the pressure exerted at the port 38, the check valve 43 will be urged closed and the operator can either hold the piston 18 in a set position or exert sufficient pressure to cause the piston 18 to be moved in the opposite direction. This can be done even while the pump 32 is being operated.

However, in order to avoid the necessity for the operator to override or overcome the pressure of the pump 32, the system is provided with a control device, indicated generally by the reference numeral 62 and shown in most detail in FIG. 2, for disabling the operation of the pump 32 when manual control is being exerted. The control device 62 is operated to achieve this end by sending a control signal from a contact 63 to the controlling device 28 so as to disable the fluid pump 32. This may be done by either stopping the electric motor 32, moving the solenoid valve 36 to its fully closed position or both.

The controlling device 62 includes a pair of fluid operated pistons 64 and 65 that are exposed to the pressure in their respective lines 53 and 54 through conduits 66 and 67, respectively. One-way check valves 68 and 69 are interposed in the conduits 66 and 67 so as to permit flow to the respective pistons 64 and 65 while preventing reverse flow. Restricted orifices 71 and 72 are placed in shunting circuits around the check valves 68 and 69 so as to provide a time delay, for a reason to be described.

The pistons 64 and 65 are normally urged upwardly by a coil compression spring 73 so that the contact 63 will not be activated and normal automatic control is possible. If, however, the operator attempts manual control by turning the steering wheel 44 and operating the pump 45, either the line 53 or the line 54 will be pressurized depending upon the direction of rotation. If the line 53 is pressurized, the fluid pressure will be transmitted through the conduit 66 and the piston 64 and urge it downwardly to close the contact 63 and disengage the automatic control. Once the operator releases the manual steering, the fluid which has displaced the piston 64 will be returned through the system through the restriction 71 under the action of the spring 73 to effect a time delay. When the piston 64 reaches its normal position, the contact 63 will be reopened and automatic control re-energized. If steering is accomplished in the opposite direction, the line 67 will be pressurized and the piston 65 will be activated so as to achieve the same cutoff of the automatic control.

It should be understood that different types of automatic control devices than that shown in FIG. 2 may be employed. For example, the device may comprise piezoelectric pressure sensors which include a timer for deactivating the controller 28 for a period of time and then cancelling the signal after that time has elapsed. Various other devices can be provided for this purpose or, if desired, the control device 62 may be eliminated entirely. In either event, there also may be provided a manual switch for the operator to deactivate the controller 28.

It should be noted that the check valves 55 and 56 serve the main purpose of providing against any pressure feedback to the steering wheel 44 due to the hydrodynamic forces operating on the outboard drive 11 when the operator has his hands on the steering wheel 44 but is not effecting a change in the steering position. Various other changes and modifications may be made without departing from the spirit and scope of the invention as defined by the appended claims.

We claim:

1. In a steering system comprising a steered member, a single power device for operating said steered member, an automatic control device for providing a first source of power operating said single power device for placing said steered member in a position set by an operator, and manual steering means for providing a second source of power manually operating said single power device for positioning said steering member in response to a manual operator control and independent of said automatic control device and means responsive to the operation of said manual steering means for disabling said automatic control device from applying said first source of power for operating said single power device so that said second source of power does not have to overpower said first source of power to effect manual control.

2. In a steering system as set forth in claim 1 wherein the automatic control device comprises a position setter operative by the operator for setting a desired steered condition, a sensing member associated with the steered member for determining the position of the steered member and comparator means for sensing the difference between the desired and the sensed position and for operating the power device to bring coincidence therewith.

3. In a steering system as set forth in claim 2 wherein the manual steering means is operative to operate the power device and override the automatic control device upon manual operator control.

4. In a steering system as set forth in claim 1 wherein the power device comprises a fluid motor.

5. In a steering system as set forth in claim 4 wherein the automatic control device comprises a position setter operative by the operator for setting a desired steered condition, a sensing member associated with the steered member for determining the position of the steered member and comparator means for sensing the difference between the desired and the sensed position and for operating the power device to bring coincidence therewith.

6. In a steering system as set forth in claim 5 wherein the manual steering means is operative to operate the fluid motor and override the automatic control device upon manual operator control.

7. In a steering system as set forth in claim 4 wherein the automatic control is operative to selectively apply fluid pressure to first and second ports of the fluid motor for driving the steered device in selected directions and wherein the manual steering means comprises a positive displacement pump operated by a steering wheel for selectively applying pressure to the fluid motor ports.

8. In a steering system as set forth in claim 7 wherein the positive displacement pump cooperates with the fluid ports of the fluid motor in parallel relationship to the automatic control and further including check valve means for precluding reverse flow through the hydraulic communication during either automatic or manual control.

9. In a steering system as set forth in claim 8 wherein the automatic control comprises a fluid pump and the sensing means is operative to discontinue the operation of the fluid pump upon operation of the positive displacement pump.

10. In a steering system comprising a steered member, a fluid motor for operating said steered member, an automatic control device for supplying fluid under pressure from a first fluid pump for placing said steered member in a position set by an operator, and manual steering means including a manually operable fluid pump for manually operating said fluid motor for positioning said steering member in response to a manual operator control and means responsive to operation of said manual steering means for precluding fluid communication between said first fluid pump and said fluid motor.

11. In a steering system as set forth in claim 10 wherein the automatic control device comprises a position setter operative by the operator for setting a desired steered condition, a sensing member associated with the steered member for determining the position of the steered member and comparator means for sensing the difference between the desired and the sensed position and for operating the fluid motor to bring coincidence therewith.

12. In a steering system as set forth in claim 11 wherein the automatic control device operates an automatic fluid pump other than the manually operable fluid pump.

13. In a steering system as set forth in claim 12 wherein the automatic control device comprises a position setter operative by the operator for setting a desired steered condition, a sensing member associated with the steered member for determining the position of the steered member and comparator means for sensing the difference between the desired and the sensed position and for operating the automatic fluid pump to bring coincidence therewith.

14. In a steering system as set forth in claim 12 wherein the automatic fluid pump is operative to selectively apply fluid pressure to first and second ports of the fluid motor for driving the steered device in selected directions and wherein the manual fluid pump comprises a positive displacement pump operated by a steering wheel for selectively applying pressure to the fluid motor ports.

15. In a steering system as set forth in claim 14 wherein the positive displacement pump cooperates with the fluid ports of the fluid motor in parallel relationship to the automatic control and further including check valve means for precluding reverse flow through the hydraulic communication during either automatic or manual control.

* * * * *